United States Patent [19]

Taylor

[11] Patent Number: 4,522,569

[45] Date of Patent: Jun. 11, 1985

[54] VENTING FUEL VALVE FOR DIESEL ENGINE FUEL SUPPLY SYSTEM

[75] Inventor: John H. Taylor, Orchard Park, N.Y.

[73] Assignee: McGard, Inc., Buffalo, N.Y.

[21] Appl. No.: 437,301

[22] Filed: Oct. 28, 1982

[51] Int. Cl.[3] ..... F02M 59/00

[52] U.S. Cl. ..... 417/434; 417/441; 131/625.21; 180/287; 123/198 B; 123/198 DB; 251/143

[58] Field of Search ..... 417/434, 435, 441; 123/198 DB, 198 B, 509, 510, 511, 512, 513, 514; 251/143, 148; 137/625.24; 180/287

[56] References Cited

U.S. PATENT DOCUMENTS

| | | | |
|---|---|---|---|
| 246,467 | 8/1881 | Cridge | 137/625.24 |
| 1,025,105 | 4/1912 | Youngs | 70/242 |
| 1,082,935 | 12/1913 | Cross | 70/242 |
| 1,329,943 | 2/1920 | Weller et al. | 70/242 |
| 1,438,802 | 12/1922 | Wilbur | 70/242 |
| 1,475,275 | 11/1923 | Bowman et al. | 70/243 X |
| 2,059,688 | 11/1936 | Gamage et al. | 123/198 B |
| 2,638,883 | 5/1953 | Simon | 123/198 B |
| 2,904,121 | 9/1959 | Honeyman | 123/198 B |
| 3,241,408 | 3/1966 | McCawley | 81/436 |
| 3,630,306 | 12/1971 | Shur | 70/243 X |
| 3,682,267 | 8/1972 | Kayser | 70/242 X |
| 3,782,862 | 1/1974 | Cammi | 417/313 |
| 3,919,868 | 11/1975 | Lipschutz | 70/243 X |
| 3,945,603 | 3/1976 | Fraser | 137/625.24 |
| 3,949,581 | 4/1976 | Toyama | 70/243 X |
| 4,119,171 | 10/1978 | Remontet | 70/243 X |
| 4,131,127 | 12/1978 | Ferro et al. | 70/242 |

FOREIGN PATENT DOCUMENTS

| | | | |
|---|---|---|---|
| 1047237 | 12/1953 | France | 123/198 DB |
| 87828 | 1/1921 | Switzerland | 251/143 |

*Primary Examiner*—Leonard E. Smith

*Attorney, Agent, or Firm*—Joseph P. Gastel

[57] ABSTRACT

A diesel engine fuel supply system having an injector pump, a fuel tank, a fuel inlet conduit between the fuel tank and the injector pump and a fuel return conduit between the injector pump and the fuel tank, a venting fuel valve including a valve body, an adapter for mounting the valve body on the injector pump, a fuel inlet on the valve body for receiving the fuel inlet conduit, a fuel outlet on the valve body for transmitting fuel to the injector pump, a vent in the valve body in communication with the atmosphere, a valve spool in the valve body movable to a first position for effecting communication between the fuel inlet and the fuel outlet to supply fuel to the injector pump while preventing venting of the fuel outlet to the atmosphere through the venting means, and the valve spool being movable to a second position for preventing communication between the fuel inlet and the fuel outlet and for effecting communication between the injector pump and the atmosphere to thereby vent the injector pump and prevent flow of fuel through the fuel return conduit to the injector pump when the injector pump is caused to operate, and an endless curvilinear groove in the valve spool for receiving a mating ridge on a key for turning the valve spool between the first and second positions.

8 Claims, 16 Drawing Figures

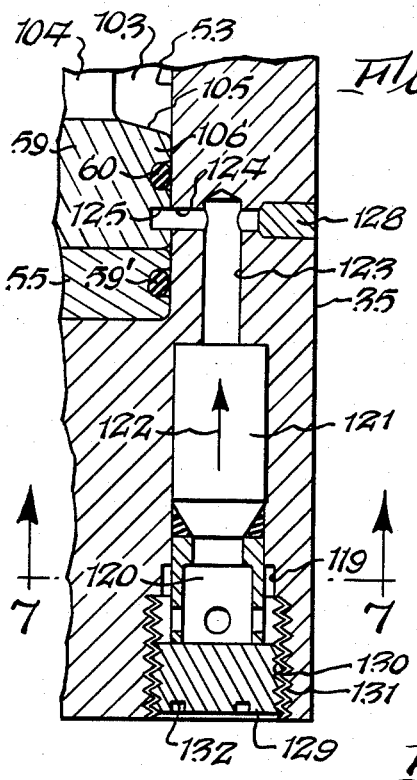
Fig. 6
Fig. 7.
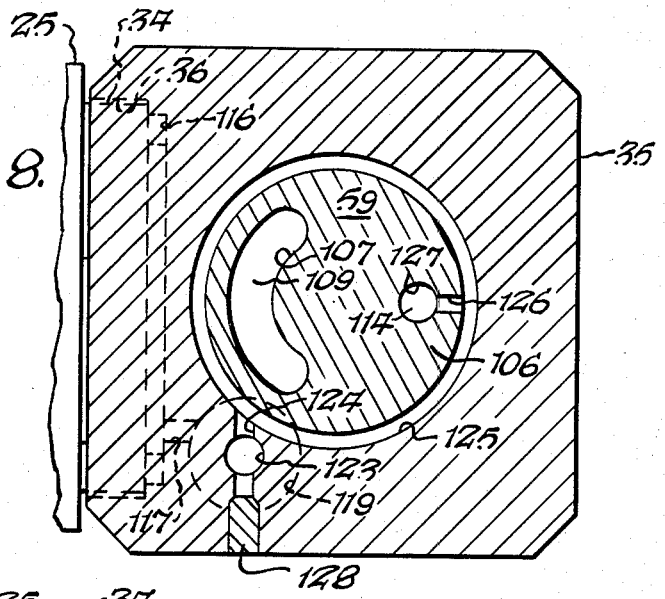
Fig. 8.
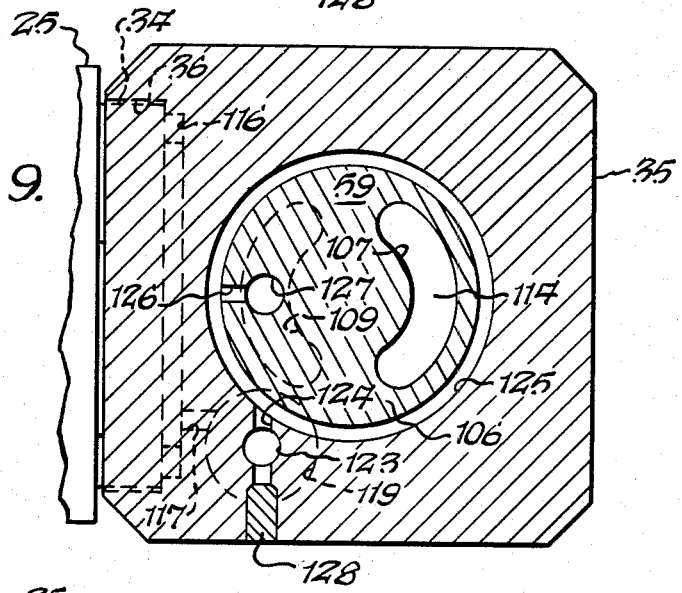
Fig. 9.
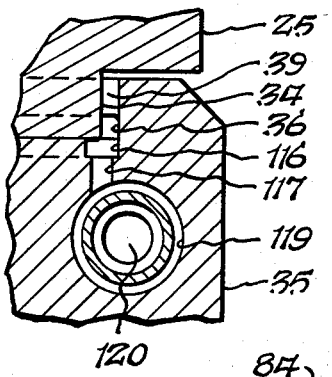
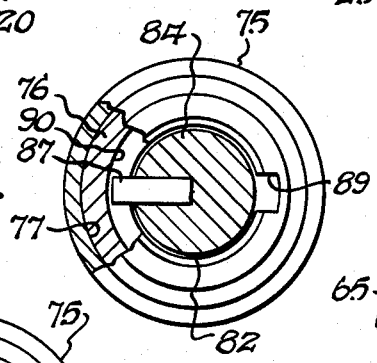
Fig. 11.
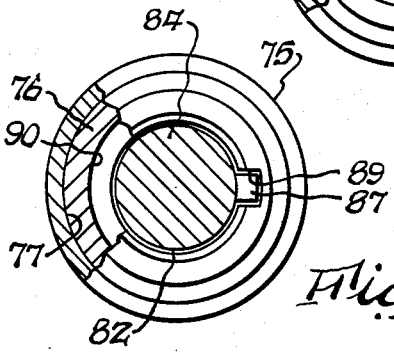
Fig. 12
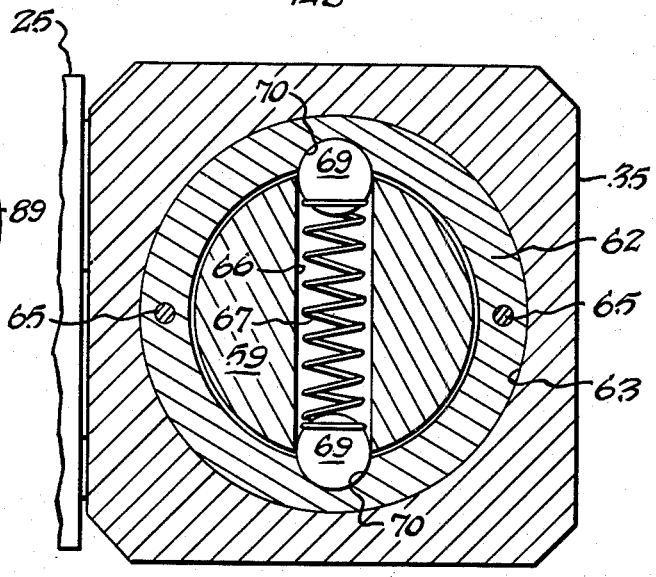
Fig. 10.

VENTING FUEL VALVE FOR DIESEL ENGINE FUEL SUPPLY SYSTEM

BACKGROUND OF THE INVENTION

The present invention relates to a venting fuel valve for a diesel engine fuel supply system which can be opened only by means of a proper key and which cannot be demounted from a diesel engine injector pump on which it is mounted by the use of conventional tools and which will vent the injector pump when it is not in a position to permit fuel to pass therethrough, and the present invention also relates to an improved valve for mounting between a fluid inlet conduit and an external object.

By way of background, the theft of heavy equipment, such as bulldozers, graders, caterpiller tractors and other types of machinery utilizing diesel engines, has become extremely prevalent. Equipment of this type can normally be started by merely turning on the ignition and driving the equipment away.

In my copending application Ser. No. 370,355, filed Apr. 21, 1982, a fuel control valve has been disclosed which utilizes a special key and which can be turned off so as to prevent flow of diesel fuel to the injector pump. However, in certain diesel engine systems there is a fuel return line from the injector pump to the fuel tank. In systems of this type if the injector pump should be actuated, sufficient fuel can be drawn from the fuel tank through the return line so as to permit the diesel engine to operate for sufficiently long periods of time to drive the equipment onto a flat bed so that it can be transported to a remote location. It is with an improvement over the above-described prior fuel valve that the present invention is concerned.

SUMMARY OF THE INVENTION

It is primary object of the present invention to provide an improved fuel valve for mounting on the injector pump of a diesel engine which can be opened only by the use of a special key and which will vent the injector pump when the valve is turned off so that diesel fuel cannot be drawn into the injector pump from the return line leading from the fuel tank.

It is another object of the present invention to provide an improved valve construction for mounting in locking relationship to an external object. Other objects and attendant advantages of the present invention will readily be perceived hereafter.

The present invention relates to an improvement in a diesel engine fuel supply system having an injector pump, a fuel tank, a fuel inlet conduit between the fuel tank and the injector pump, and a fuel return conduit between the injector pump and the fuel tank, the improvement comprising a venting fuel valve including a valve body, mounting means for mounting said valve body on said injector pump, a fuel inlet on said valve body for receiving said fuel inlet conduit, a fuel outlet on said valve body for transmitting fuel to said injector pump, venting means in said valve body in communication with the atmosphere, valve means in said valve body movable between first and second positions, first conduit means in said fuel valve operable in said first position for effecting communication between said fuel inlet and said fuel outlet to supply fuel to said injector pump while preventing venting of said fuel outlet to the atmosphere through said venting means, and second conduit means in said fuel valve operable in said second position for preventing communication between said fuel inlet and said fuel outlet and for effecting communication between said injector pump and the atmosphere through said fuel outlet and said venting means to thereby vent said injector pump and prevent flow of fuel through said fuel return conduit to said injector pump when said injector pump is caused to operate.

The present invention also relates to a valve construction for mounting in locking relationship to an external object comprising a valve body, a bore in said valve body, a nipple-like member having first and second ends, a central portion on said nipple-like member located within said bore, means on said first end of said nipple-like member for attachment to said external object, means on said second end for locking said valve body on said nipple-like member, a fluid inlet on said valve body, a fluid outlet at said first end of said nipple-like member, valve means in said body member for selective movement between first and second positions, and conduit means in said valve body and valve means and nipple-like member for effecting communication between said fluid inlet and said fluid outlet when said valve means is in said first position and for terminating said communication when said valve means is in said second position.

The various aspects of the present invention will be more fully understood when the following portions of the specification are read in conjunction with the accompanying drawings wherein:

BRIEF DESCRIPTION OF THE DRAWINGS

FIG. 6 is a fragmentary cross sectional view taken substantially along line 6—6 of FIG. 5 and showing a portion of the porting in the valve body for venting the valve in the off position;

FIG. 7 is a fragmentary cross sectional view taken substantially along line 7—7 of FIG. 6 and showing further details of the porting in the valve body for effecting venting;

FIG. 8 is a fragmentary cross sectional view taken substantially along line 8—8 of FIG. 2 and showing the valve in an open position to permit fuel flow while preventing venting;

FIG. 9 is a view similar to FIG. 8 but taken on line 9—9 of FIG. 3 and showing the valve with the spool in an off position to prevent fuel flow while permitting venting;

FIG. 10 is a fragmentary cross sectional view taken substantially along line 10—10 of FIG. 2 and showing the ball detent construction for holding the valve spool either in an on or off position;

FIG. 11 is a fragmentary cross sectional view taken substantially along line 11—11 of FIG. 2 and showing the key in a locked position which it occupies when the valve is open;

FIG. 12 is a fragmentary cross sectional view taken substantially along line 12—12 of FIG. 3 and showing the key in the position which it occupies when the valve is closed and when the key can be withdrawn from the valve;

DESCRIPTION OF THE PREFERRED EMBODIMENTS

Figures 1, 2, 2A, 13:
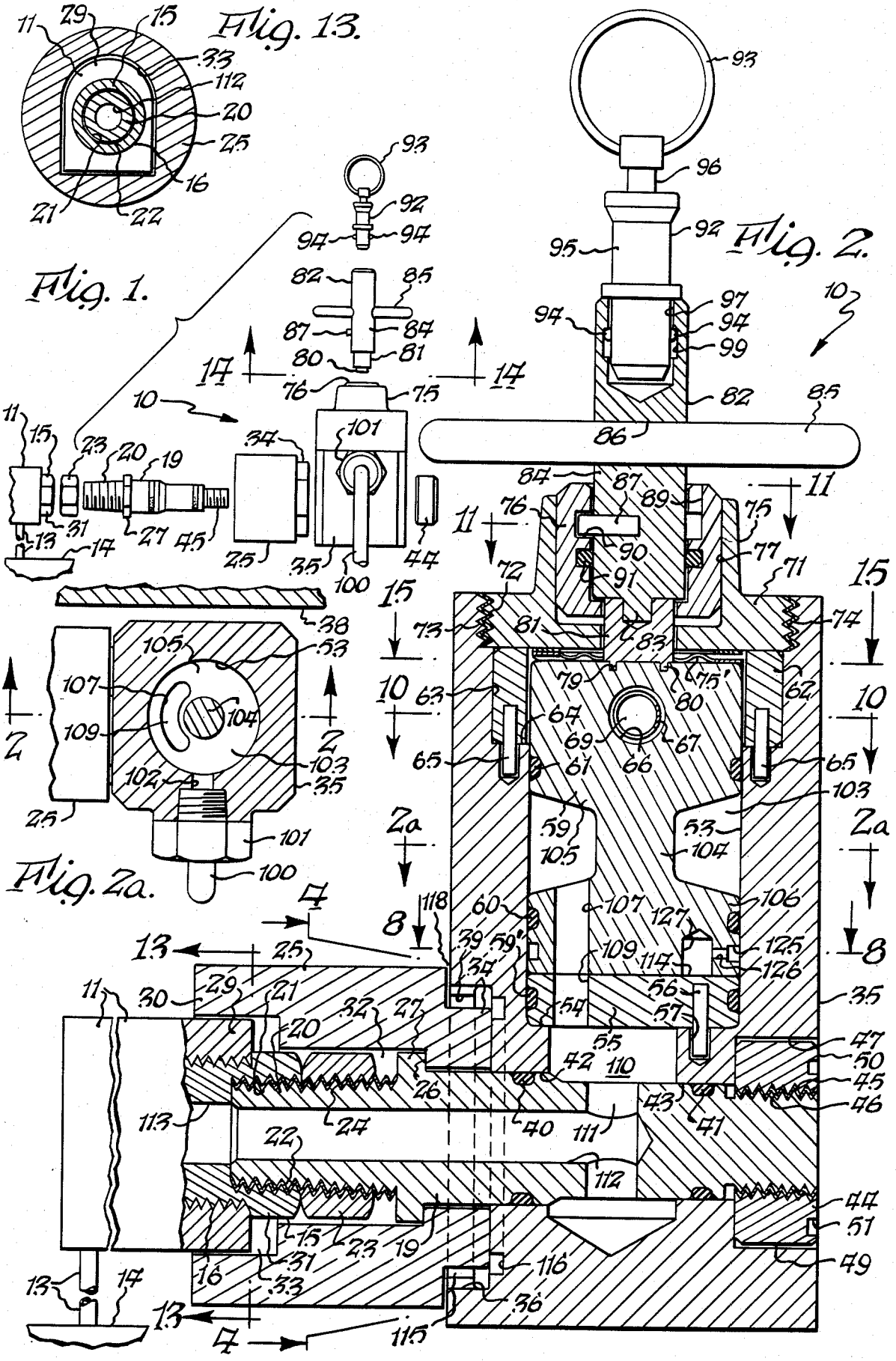
FIG. 1 is a fragmentary side elevational view exploded view of the improved valve of the present invention located relative to an injector pump of a diesel engine onto which it is to be mounted.
FIG. 2 is a fragmentary cross sectional view taken substantially along line 2—2 of FIG. 2*a* and showing the valve in an on position wherein it permits fuel flow therethrough.
FIG. 2*a* is a fragmentary cross sectional view taken substantially along line 2*a*—2*a* of FIG. 2.
FIG. 13 is a cross sectional view taken substantially along line 13—13 of FIG. 2 and showing the adapter mounted on the injector pump.

The venting fuel valve 10 of the present invention is mounted on injector pump 11 attached to a diesel engine (not shown) for permitting either fuel flow to the diesel engine injectors when valve 10 is in an open position or for preventing such fuel flow and venting injector pump 11 when valve 10 is in an off position. As noted briefly above, the reason that venting is necessary is that the injector pump will always have some fuel left in it even though valve 10 is closed. If injector pump 11 is not vented when valve 10 is closed, this fuel can be forced into the engine when the pump 11 is actuated. In addition, there is also a return line 13 between injector pump 11 and fuel tank 14 and return line 13 leads to the bottom of tank 14. If the injector pump 11 is actuated, a vacuum is created therein which will draw fuel from return line 13. Sufficient fuel can be supplied to the diesel engine in this way to permit the engine to operate in short bursts, thus permitting a vehicle to be moved sufficiently to drive it onto a flat bed. By employing the venting mechanism of valve 10, the foregoing supply of fuel from tank 14 to injector pump 11 via return line 13 can be prevented.

Valve 10 is mounted on injector pump 11 in the following manner. A male fitting 15 (FIG. 2) is threaded into tapped bore 16 of injector pump 11. Fitting 15 is a part of the pump and can contain a pressure regulating device (not shown) or a filter screen (not shown). A nipple-like member 19 has its threaded end portion 20 threaded into tapped opening 21 in fitting 15 with anaerobic coating 22 therebetween. The coating 22 will become activated after the parts are assembled so that member 19 will be locked into fitting 15. The anaerobic coating 22 permits member 19 to be installed with relatively little torque, but after it has been activated by the lack of oxygen, the parts can only be separated by the application of an extremely high torque. An anaerobic coating which is satisfactory is known under the trademark DRY-LOCK, Formula 200, which is a product of Loctite Corporation. The anaerobic coating which is applied to other parts discussed hereafter is of the same type. Thereafter, a combined lock and seal nut 23 is tightened into abutting engagement with fitting 15, with anaerobic coating 24 therebetween. Nut 23 may have a plastic sealing face (not shown) which abuts the adjacent face of fitting 15. Thus, nipple-like member 19 will be firmly secured in fluid-tight relationship with injector pump 11.

Figure 4:
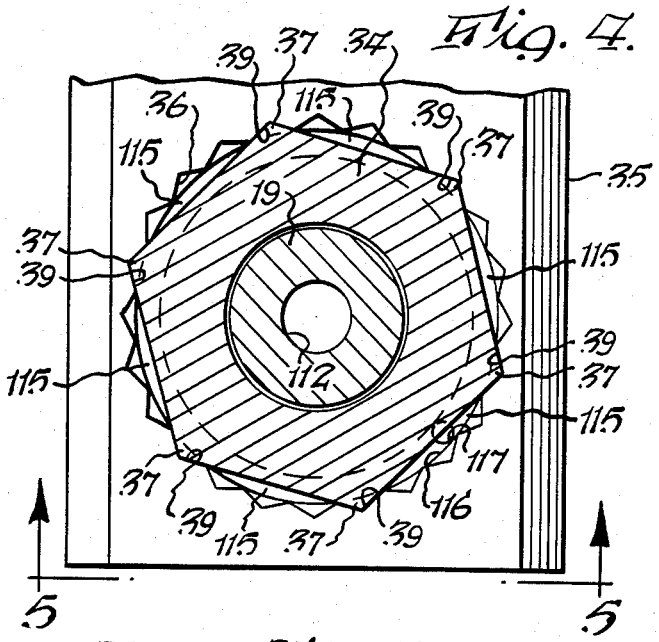
FIG. 4 is a fragmentary cross sectional view taken substantially along line 4—4 of FIG. 2 and showing the manner in which the valve body is mounted on the adapter and the clearance therebetween.

An adapter 25 is then slipped from right to left in FIG. 1 over nipple-like member 19 until annular shoulder 26 of adapter 25 engages collar 27 of member 19. Collar 27 has a pair of parallel flats thereon for receiving a wrench during installation of member 19 onto fitting 15. The end portion 29 of injector pump 11 will be received within skirt portion or shroud 30 of adapter 25 so that hexagonal head 31 of fitting 15 is completely hidden so that it cannot be turned by the use of a wrench. Furthermore, nut 23 will be received in chamber 32 of adapter 25. The opening 33 within skirt portion 30 of adapter 25 is of a configuration for close fitting engagement with the end 29 of injector pump 11. Opening 33 may be made in the desired configuration to provide such a fit with the injectors of the different contours which exist in the field. However, the opposite end 34 of adapter 25 will be of a standard configuration to mount valve body 35. In this respect end 34 (FIGS. 1, 2 and 4) is hexagonal in shape and it has points 37 which are received in mating engagement between the serrations 39 of broached opening 36 of valve body 35. There are in this embodiment twenty-four serrations 39 which means that they are 15° apart. This permits the valve body 35 to be mounted in any desired attitude on nut 34 at 15° increments. Adapter 25 is fabricated from steel which has been heat-treated and hardened so that it cannot be sawed, chiseled, or otherwise destroyed or defaced.

Figure 15:
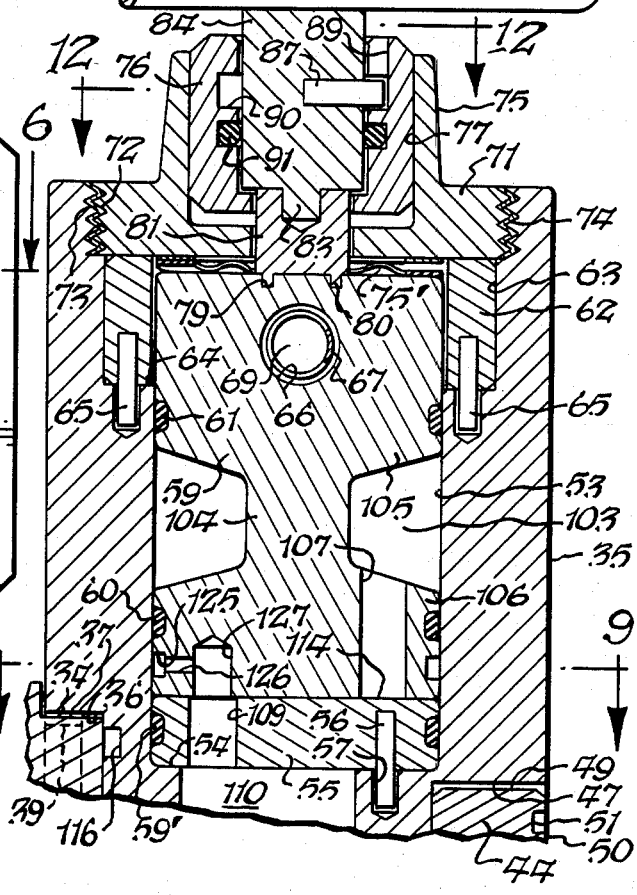
FIG. 15 is a cross sectional view taken substantially along line 15—15 of FIG. 2 and showing the endless curvilinear groove in the valve spool for receiving the key of FIG. 14.
Figure 15:
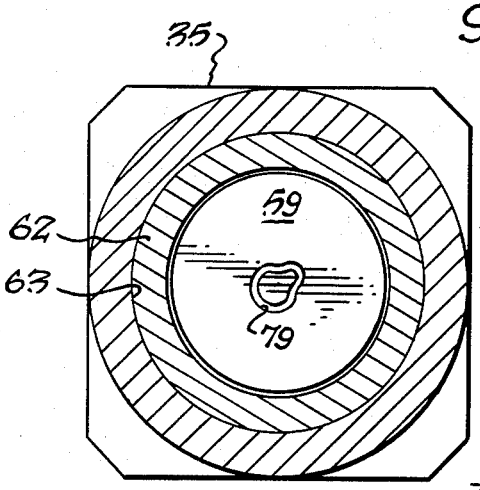
Figure 14:
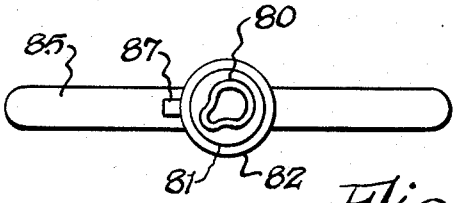
FIG. 14 is a view taken in the direction of the arrows 14—14 of FIG. 1 and showing the endless curvilinear ridge on the key.

Valve body 35 is mounted onto fitting 19 by slipping it from right to left in FIG. 2 until broached opening 36 receives adapter end 35 in the desired relative orientation with O-rings 40 and 41 between member 19 and bores 42 and 43, respectively, of valve body 35. Thereafter, a nut 44 is threaded onto fitting end 45 with anaerobic locking compound 46 therebetween, nut 44 being received in counterbore 47 of valve body 35. Nut 44 preferably has a cylindrical outer surface 49 and it is hardened so that it cannot be defaced by chiseling. The amount of torque required to loosen nut 44 after the anaerobic coating has set is approximately 60–65 foot pounds. Nut 44 includes in its face 50 an endless curved groove 51, such as the type described in detail in U.S. Pat. No. 3,241,408 which is incorporated herein by reference. Thus, nut 44 can be turned only by a key having a curved ridge (not shown) which fits in mating complementary relationship with groove 51, as described in detail in U.S. Pat. No. 3,241,408. Examples of a curved ridge and groove are shown in FIGS. 14 and 15. It will be appreciated that there are an infinite number of configurations for the ridge and groove, as described in detail in U.S. Pat. No. 3,241,408, so that the key and groove will not be of a standard configuration, and thus different nuts 44 can be supplied for different installations so that keys of one installation need not fit nuts of a different installation.

In its mounted position on adapter 25, valve body 35 is so oriented relative to the engine block 38 so that if an attempt is made to pivot valve body 35 about the axis of nipple-like member 19, valve body 35 will abut the engine block 38 within a relatively few degrees of pivotal movement, usually much less than 180°. Furthermore, if a wrench is used to turn adapter 25 or valve body 35, the end 29 of the injector pump 11 will be destroyed, considering the locking connections between the injector pump, adapter and valve body, and thus pump 11 will be rendered inoperative.

Valve body 35 contains a bore 53 terminating at annular shoulder 54 upon which is seated a valve seat 55 and retained against rotation thereon by pin 56 which extends between a bore in the valve seat 55 and bore 57 in the valve body. O-ring 59' is located between valve seat 55 and bore 53. A valve spool 59 is received in bore 53 and maintained in sealing relationship therewith by O-rings 60 and 61. A detent ring 62 is received in counterbore 63 of valve body 35 and seats against annular shoulder 64. Pins 65 extend between suitable bores in the detent ring and the valve body to hold the ring against rotation. A bore 66 is provided in valve spool 59 and it receives a spring 67 which biases detent balls 69 outwardly into engagement with depressions 70 in ring 62. Thus valve spool 69 may be maintained in either one of two 180° apart positions by the detent arrangement.

A key holder member 71 having an outer threaded portion 72 is received in threaded relationship in tapped opening 73 of the valve body with anaerobic locking compound 74 therebetween. A spring washer 75' is interposed between the keyhole holder 71 and spool valve 59. The frustoconical outer surface 75 of keyhole holder 71 cannot be gripped by a wrench and member 71 is fabricated of hardened steel which cannot be chiseled. A keyhole member 76 is press-fitted into cylindrical bore 77 of keyhole holder 71.

The valve spool 59 includes an endless curvilinear groove 79 in its upper surface for receiving a mating endless curvilinear ridge 80 of keyhead 81. The groove 79 and ridge 80 may be fabricated in accordance with the teaching of U.S. Pat. No. 3,241,408 which is incorporated herein and may be of the type depicted in FIGS. 14 and 15. Preferably the configuration of ridge 80 will differ from the configuration of the ridge for nut 44 so that different keys are required for nut 44 and valve spool 59.

Key 82 has keyhead 81 mounting ridge 80 press-fitted on tip 83 of body portion 84 thereof. A rod 85 is press-fitted through a bore 86 in body portion 82. A pin 87 extends radially outwardly from cylindrical body 84 and in use passes through slot 89 when key 82 is inserted axially into valve body 35 until the outer end of pin 87 reaches undercut annular groove 90 which will receive the outer end of pin 87 when it is turned. Groove 89 will automatically align the ridge 80 with groove 79 upon insertion of the key. When pin 87 is in the position shown in FIG. 2, the valve is in an open position and key 82 cannot be disengaged from the valve 10. When pin 87 is in the position shown in FIG. 3, the valve is in a closed position, and key 82 can be removed from valve 10. An O-ring 91 is provided in the keyhole member 76 so as to provide a dust seal when the key 82 is in position.

Key 82 can be selectively mounted on key ring attachment 92 which is intended to be permanently mounted on a person's key ring by means of a suitable ring 93. In this respect, a pair of detents 94 are provided on key ring attachment 92 which has a body portion 95 which slidably receives shaft 96 attached to ring 93. When shaft 96 is moved downwardly into body 92, a suitable cam arrangement will release detents 94 so as to permit them to move radially inwardly as key ring adapter 92 is pulled out of bore 97. However, when key ring adapter body portion 95 is in the position shown in FIG. 2, detents 94 will be received in undercut annular portion 99 so as to retain the key 82 and the adapter 92 in assembled relationship. In this manner the key 82 and the adapter 92 can be selectively attached and detached so that key 82 may be placed on a key ring but it can be removed therefrom by the use of the adapter 92 when it is necessary to use key 82 to turn valve spool 59.

A fuel line 100 (FIGS. 1 and 2a) is in communication with valve body 35 through fitting 101 which is in turn in communication with bore 102 which in turn is in communication with annular chamber 103 surrounding reduced valve spool portion 104 between enlarged valve spool portions 105 and 106. A curved opening 107 is located in lower valve spool portion 106 to effect communication between chamber 103 and curved opening 109 in valve seat 105 when valve 10 is open as shown in FIG. 2. Opening 109 in turn is in communication with chamber 110 in valve body 35 which in turn is in communication with bore 111 in nipple-like member 19 which in turn is in communication with bore 112 in nipple-like member which is in communication with bore 113 in fitting 31 which is mounted on injector pump 11. Thus, when valve spool 59 is in an open position, fuel can flow from conduit 100 to injector pump 11 through the above described fluid circuit.

Figure 3:
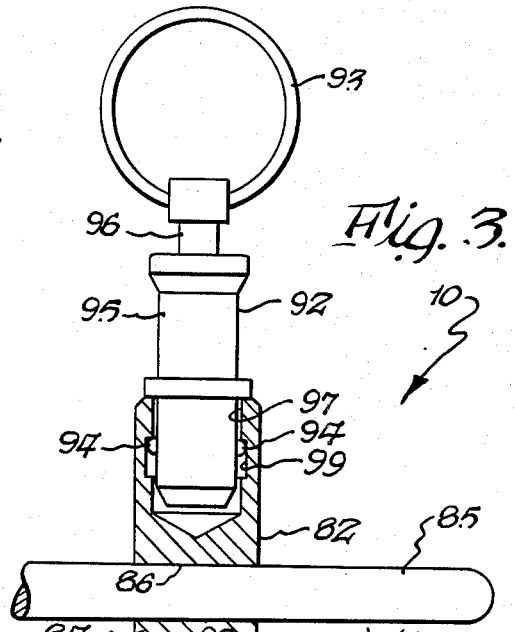
FIG. 3 is a fragmentary cross sectional view similar to FIG. 2 but showing the valve spool in an off position wherein it prevents fuel flow therethrough and vents the injector pump.

When it is desired to terminate the flow of fuel through valve 10, key 82 is turned to cause valve spool 59 to assume the position of FIG. 3 wherein the bore 107 in valve spool 59 deadends against the face 114 of valve seat 55, thereby cutting of fuel flow to opening 109. Key 82 can now be removed from the valve body 35. Valve spool 59 is now in position to permit venting of the injector pump 11 to the atmosphere to prevent the taking in of fuel through return line 13, as described above. The venting is effected through the annular space 118 between adapter 25 and valve body 35, through spaces 115 between adapter 34 and broached hole 36 (FIG. 4), through annular slot 116 in valve body 35 (FIGS. 2, 4, 8 and 9), through bore 117 (FIG. 9) which is in communication with slot 116, through chamber 119 (FIGS. 6 and 7), through filter 120 (FIG. 6), through check valve 121 which permits flow only in the direction of arrow 122, through conduit 123, through conduit 124 which has its end plugged at 128, through annular groove 125 (FIGS. 3, 6 and 9) in lower valve spool portion 106, and through bores 126 and 127 (FIG. 3) in lower spool valve portion 106 so as to effect communication with opening 109 in valve seat 55 to thereby permit venting of the injector pump 11 through conduits 110, 111 and 112.

Figure 5:
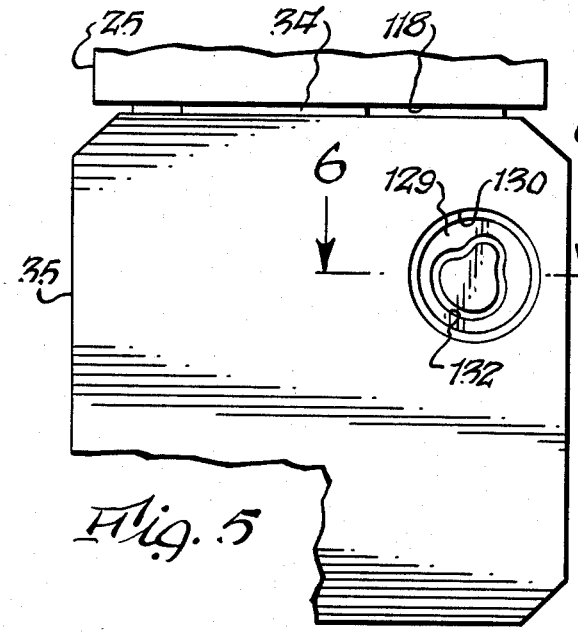
FIG. 5 is a fragmentary end elevational view taken substantially along line 5—5 of FIG. 4.

The bore in valve body 35 which receives filter 120 and check valve 122 is sealed by a nut 129 (FIGS. 5 and 6) received in tapped bore 130 with anaerobic locking compound 131 therebetween. Nut 129 has an endless curvilinear groove 132 of the type shown above in FIG. 15, but the configuration of which may be different from the configuration of the preceding discussed members having this type of curvilinear groove. It will be noted from FIG. 2 that when valve 10 is in the open position to permit flow of fuel to the injector, bore 127 through which venting must occur is dead ended against surface 114 of valve seat 55. Furthermore, check valve 121 will prevent any fuel from flowing into the venting conduits 127, 126, 125, 124 and 123. Therefore, the venting circuit cannot interfere with proper fuel flow because of the existence of check valve 122.

While the improved valve has been described relative to a diesel engine fuel supply system, it will be appreciated that the valve may also be used in other environments wherein it is desired to install a valve between an inlet conduit and a device which receives fluid from the conduit, and wherein the valve may be locked in position. It will be appreciated that the venting feature may optionally be omitted, as required for the particular installation under consideration.

It can thus be seen that the improved fuel valve of the present invention is manifestly capable of achieving the above enumerated objects, and while preferred embodiments of the present invention have been disclosed, it will be appreciated that it is not limited thereto, but may be otherwise embodied within the scope of the following claims.

What is claimed is:

1. In a diesel engine fuel supply system having an injector pump, a fuel tank, a fuel inlet conduit between the fuel tank and the injector pump, and a fuel return conduit between the injector pump and the fuel tank, the improvement comprising a venting fuel valve including a valve body, mounting means for mounting said valve body on said injector pump, a fuel inlet on said valve body for receiving said fuel inlet conduit, a fuel outlet on said valve body for transmitting fuel to said injector pump, venting means in said valve body in communication with the atmosphere, valve means in said valve body movable between first and second positions, first conduit means in said fuel valve operable in said first position for effecting communication between said fuel inlet and said fuel outlet to supply fuel to said injector pump while preventing venting of said fuel outlet to the atmosphere through said venting means, second conduit means in said fuel valve operable in said second position for preventing communication between said fuel inlet and said fuel outlet and for effecting communication between said injector pump and the atmosphere through said fuel outlet and said venting means to thereby vent said injector pump and prevent flow of fuel through said fuel return conduit to said injector pump when said injector pump is caused to operate, a mounting member having a first mounting member portion for mounting on said injector pump, a second mounting member portion for mounting said valve body, means for locking said valve body on said mounting member, said mounting member comprising an elongated nipple-like member, and said first mounting member portion comprising a first threaded portion on one end of said nipple-like member, and said second mounting member portion comprising a central portion on said nipple-like member, and said means for locking said valve body on said mounting member comprising a second threaded portion at the other end of said nipple-like member, and a nut having an endless curvilinear groove mounted on said second threaded portion and received within a recess in said valve body.

2. A valve construction for mounting in locking relationship to an external object comprising a valve body, a bore in said valve body, a nipple-like member having first and second ends, a central portion on said nipple-like member located within said bore, means on said first end of said nipple-like member for attachment to said external object, means on said second end for locking said valve body on said nipple-like member, a fluid inlet on said valve body, a fluid outlet at said first end of said nipple-like member, valve means in said body member for selective movement between first and second positions, conduit means in said valve body and valve means and nipple-like member for effecting communication between said fluid inlet and said fluid outlet when said valve means is in said first position and for terminating said communication when said valve means is in said second position, an adapter having a first end for mounting on said external object and a second end located between said first end of said nipple-like member and said central portion, and mounting means on said second end of said adapter for mounting said valve body.

3. In a diesel engine fuel supply system having an injector pump, a fuel tank, a fuel inlet conduit between the fuel tank and the injector pump, a fuel return conduit between the injector pump and the fuel tank, the improvement comprising a venting fuel valve including a valve body, mounting means for mounting said valve body on said injector pump, a fuel inlet on said valve body for receiving said fuel inlet conduit, a fuel outlet on said valve body for tranmitting fuel to said injector pump, venting means in said valve body in communication with the atmosphere, valve means in said valve body movable between first and second positions, first conduit means in said fuel valve operable in said first position for effecting communication between said fuel inlet and said fuel outlet to supply fuel to said injector pump while preventing venting of said fuel outlet to the atmosphere through said venting means, second conduit means in said fuel valve operable in said second position for preventing communication between said fuel inlet and said fuel outlet for effecting communication between said injector pump and the atmosphere through said fuel outlet and said venting means to thereby vent said injector pump and prevent flow of fuel through said fuel return conduit to said injector pump when said injector pump is caused to operate, a mounting member having a first mounting member portion for mounting on said injector pump, a second mounting member portion for mounting said valve body, means for locking said valve body on said mounting member, an adapter for mounting between said valve body and said injector pump, and second mounting means on said adapter for mounting said valve body.

4. In a diesel engine fuel supply system as set forth in claim 3 wherein said second mounting means includes cooperating connection means between said adapter and said valve body for adjustably mounting said valve body in a plurality of attitudes.

5. In a diesel engine fuel supply system as set forth in claim 3 wherein said adapter includes a shroud for encircling said first mounting member portion to thereby prevent access thereto.

6. A valve construction for mounting in locking relationship to an external object comprising a valve body, a bore extending through said entire valve body, a nipple-like member having first and second ends, a central portion on said nipple-like member located within said bore, means on said first end of said nipple-like member for attachment to said external object, means on said second end for locking said valve body on said nipple-like member against removal therefrom, a fluid inlet on said valve body, a fluid outlet at said first end of said nipple-like member, valve means in said body member for selective movement between first and second positions, and conduit means in said valve body and valve means and nipple-like member for effecting communication between said fluid inlet and said fluid outlet when said valve means is in said first position and for terminating said communication when said valve means is in said second position.

7. A valve construction as set forth in claim 6 including second conduit means for effecting venting of said fluid outlet when said valve means is in said second position.

8. A valve construction as set forth in claim 6 wherein said valve means comprises a rotatable valve spool, and a curvilinear groove in said valve spool for receiving a mating curvilineear ridge of a key for moving said valve spool between said first and second positions.

* * * * *

UNITED STATES PATENT AND TRADEMARK OFFICE

CERTIFICATE OF CORRECTION

PATENT NO. : 4,522,569

DATED : June 11, 1985

INVENTOR(S) : John H. Taylor

It is certified that error appears in the above-identified patent and that said Letters Patent are hereby corrected as shown below:

Column 8, line 11 (claim 3), before "a fuel return" insert --and--;

line 17 (claim 3), change "tranmitting" to --transmitting--;

line 28 (claim 3), before "for effecting" insert --and--.

Signed and Sealed this

*Tenth* Day of *September 1985*

[SEAL]

*Attest:*

DONALD J. QUIGG

*Attesting Officer* *Acting Commissioner of Patents and Trademarks - Designate*